US010640985B2

(12) United States Patent
Strehlow et al.

(10) Patent No.: US 10,640,985 B2
(45) Date of Patent: May 5, 2020

(54) DEVICE FOR FASTENING A PANEL-SHAPED COMPONENT IN A RECEIVING GROOVE OF A CARRYING RAIL

(71) Applicant: BOHLE AG, Haan (DE)

(72) Inventors: Lutz Strehlow, Solingen (DE); Daniel Büchner, Leverkusen (DE); Frank Windmann, Langenfeld (DE)

(73) Assignee: BOHLE AG, Haan (DE)

( * ) Notice: Subject to any disclaimer, the term of this patent is extended or adjusted under 35 U.S.C. 154(b) by 0 days.

(21) Appl. No.: 16/316,773

(22) PCT Filed: Jul. 12, 2017

(86) PCT No.: PCT/EP2017/067626
§ 371 (c)(1),
(2) Date: Jan. 10, 2019

(87) PCT Pub. No.: WO2018/011309
PCT Pub. Date: Jan. 18, 2018

(65) Prior Publication Data

US 2019/0249442 A1 Aug. 15, 2019

(30) Foreign Application Priority Data

Jul. 12, 2016 (DE) ..... 10 2016 112 775

(51) Int. Cl.
*E04H 17/16* (2006.01)
*E04F 11/18* (2006.01)

(52) U.S. Cl.
CPC ..... *E04F 11/1817* (2013.01); *E04F 11/1851* (2013.01); *E04F 11/1853* (2013.01); *E04F 2011/1823* (2013.01)

(58) Field of Classification Search
CPC ..... E04F 11/1817; E04F 11/1851; E04F 11/1853; E04F 2011/1819;
(Continued)

(56) References Cited

U.S. PATENT DOCUMENTS 5,419,744 A * 5/1995 Kagebeck ..... F16B 2/08 474/253
6,666,615 B2 * 12/2003 Mukouyama ..... F16B 5/0233 403/374.1

(Continued)

FOREIGN PATENT DOCUMENTS

CA 2881046 A1 8/2015
DE 3407963 A1 * 9/1985 ..... E02D 5/08

(Continued)

*Primary Examiner* — Matthew R McMahon
(74) *Attorney, Agent, or Firm* — Harness, Dickey & Pierce, P.L.C.

(57) ABSTRACT

A device for fastening a panel-shaped component in a receiving groove of a carrying rail, comprises a holding element for holding the panel-shaped component in the receiving groove such that an end face of the panel-shaped component introduced into the receiving groove is supported on the bottom of the receiving groove via the holding element, two clamping elements for clamping the panel-shaped component between the flanks of the receiving groove, and at least one tension anchor for positioning the clamping elements. At least one of the tension anchors is flexible and reaches over from one side of the panel-shaped component around the end face of the panel-shaped component to the clamping element, which is to be positioned by the flexible tension anchor, on the other side of the panel-shaped component.

13 Claims, 4 Drawing Sheets

(58) Field of Classification Search
CPC ..... E04F 2011/1823; E04F 2011/1831; Y10T 403/7064; F16B 2/14; F16B 2/08
USPC ..... 256/24
See application file for complete search history.

(56) References Cited

U.S. PATENT DOCUMENTS

| | | | | |
|---|---|---|---|---|
| 7,954,289 | B2 * | 6/2011 | Evans | E04H 12/2269 248/530 |
| 9,683,402 | B2 * | 6/2017 | Abdul Lathief | E06B 3/66304 |
| 9,840,357 | B2 * | 12/2017 | Kierstead | B65D 63/14 |
| 10,030,393 | B2 * | 7/2018 | Spence | E04F 11/1812 |
| 10,384,758 | B2 * | 8/2019 | Mills | B32B 7/02 |
| 2011/0162171 | A1 * | 7/2011 | Gmeilbauer | F16B 2/08 24/16 R |
| 2015/0240851 | A1 | 8/2015 | Giacometti et al. | |
| 2017/0370108 | A1 * | 12/2017 | Groeneweg | E04F 11/1836 |
| 2018/0135669 | A1 * | 5/2018 | Dagand | F16B 2/14 |

FOREIGN PATENT DOCUMENTS

| | | | | |
|---|---|---|---|---|
| DE | 202010016190 | U1 | 5/2011 | |
| DE | 202017105698 | U1 * | 12/2017 | F16B 2/185 |
| DE | 202017105703 | U1 * | 1/2018 | E04F 11/1817 |
| DE | 202018106311 | U1 * | 12/2018 | E04F 11/1853 |
| EP | 2921607 | A2 | 9/2015 | |
| FR | 2930270 | A1 * | 10/2009 | E04F 11/1851 |

* cited by examiner

DEVICE FOR FASTENING A PANEL-SHAPED COMPONENT IN A RECEIVING GROOVE OF A CARRYING RAIL

CROSS-REFERENCE TO RELATED APPLICATIONS

This application is a National Stage of International Application No. PCT/EP2017/067626 filed on Jul. 12, 2017. This application claims the priority to German Patent Application No. 10 2016 112 775.2, filed on Jul. 12, 2016. The entire disclosures of the above applications are incorporated herein by reference.

FIELD

The disclosure relates to a device for fastening a panel-shaped component in a receiving groove of a carrying rail, comprising (i) a holding element for holding the component in the receiving groove such that an end face of the component inserted into the receiving groove is supported at the groove bottom of the receiving groove via the holding element, (ii) two clamping elements for clamping the panel-shaped component between the groove flanks of the receiving groove, and (iii) at least one tension anchor for positioning the clamping elements.

BACKGROUND

This section provides background information related to the present disclosure which is not necessarily prior art.

Such a fastening device is known as a device for fastening a glass panel of a glass balustrade. CA 2881046 A1 shows a device for fastening a glass panel in a receiving groove of a substantially U-shaped carrying rail. The device comprises a holding element for holding the component in the receiving groove, wherein an end face of the component inserted into the receiving groove can be supported at the groove bottom of the receiving groove via the holding element. The device further comprises two wedge-shaped clamping elements for wedging the panel-shaped component between the groove flanks of the receiving groove and two tension anchors formed as screws for positioning the clamping elements. Each of the screws extends through one of the clamping elements and is screwed into the holding element acting as a counterpart.

In a balustrade an assembling and fastening option of one of the two sides of the subsequently assembled and fastened panel-shaped components is desired because with a balustrade the access to the other side is not readily available. But even with the assembly and fastening of a panel-shaped component at some other point an assembly and fastening option from either of both sides is much more convenient and efficient to perform.

SUMMARY

This section provides a general summary of the disclosure, and is not a comprehensive disclosure of its full scope or all of its features.

It is the object of the present disclosure to provide means which allow a fastening of a panel-shaped component in a receiving groove of a carrying rail, wherein this fastening process can be carried out from one side of the panel-shaped component inserted into the groove.

The object is achieved according to the disclosure by the features of the independent claims. Preferred embodiments of the disclosure are specified in the dependent claims and the following description, which individually or in combination may constitute an aspect of the disclosure.

In the device according to the disclosure for fastening a panel-shaped component in a receiving groove of a carrying rail, abbreviated as fastening device, it is provided that the (only) tension anchor or at least one of the (plurality of) tension anchors is configured flexible and extends from one side of the panel-shaped component around the end face of the component up to the clamping element to be positioned by means of this flexible tension anchor at the other side of the component opposite to the one side. By this measure, it is enabled that not only the clamping element, which is disposed on the one side of the panel-shaped component, but also the clamping element on the other side can be positioned/manipulated from the one side of the panel-shaped component inserted into the receiving groove. This has the advantage that a user (operator) of the fastening device is able to position/manipulate both clamping elements from the one side of the component, which represents a huge improvement in particular for the above-mentioned balustrades. The panel-shaped component is preferably a panel-shaped component made of glass, i.e., in particular a glass panel or a glass panel composite. Critical to the function of the tension anchor as such is its tensile strength. This characteristic is often equally guaranteed for flexible components as for rather rigid components.

Advantageously, not only the one clamping element but both clamping elements can be positioned by means of the flexible tension anchor. To this end, the tension anchor must act between the two clamping elements.

The clamping elements are provided to enable a clamping of the panel-shaped component in a preselected orientation. For this purpose, the clamping elements are formed corresponding to or at least similar to the positioning wedges known from the aforementioned CA 2881046 A1. According to a preferred embodiment of the disclosure it is therefore provided that the clamping elements each have a wedge shape for wedging the panel-shaped component between the groove flanks of the receiving groove. The clamping of the panel-shaped component is thus a wedging. In principle, an embodiment is conceivable in which only one of the clamping elements has a wedge shape. In principle, the flanks of the wedge-shaped clamping elements, that is the wedge surfaces, of course, can be formed planar. However, in planar wedge surfaces—depending on the angular position of the panel-shaped component—undefined positionings of the corresponding wedge-shaped clamping element can occur under certain circumstances. Therefore, it is advantageously provided that one or both flanks of both or at least one of the wedge-shaped clamping elements has a (slight) curvature. The advantage of such a curvature is that it is thus ensured that the one side of the wedge-shaped clamping element abuts always planar at its counterface, while the other side of the wedge-shaped clamping element in each case abuts at least approximately centrally line-shaped, or that both sides of the wedge-shaped clamping element abut at least approximately centrally line-shaped.

According to a preferred embodiment of the disclosure it is provided that the flexible tension anchor is deflected by means of the holding element from the one side of the component to the other side of the component. For this purpose, the flexible tension anchor is guided, for example, along a deflection surface of the holding member or at least over one roll/roller of the holding element.

According to another preferred embodiment of the disclosure it is provided that the holding element is formed as a holding element which enables a tilting of the component inserted in the receiving groove, but not yet clamped. For this purpose, the groove bottom, for example, comprises a semi-circular contour in which the correspondingly shaped holding element can be tilted.

According to yet another preferred embodiment of the disclosure the flexible tension anchor is adapted to connect the clamping element tension-proof on the one side of the panel-shaped component to the clamping element on the other side of the panel-shaped component. In this way, by means of the one flexible tension anchor both clamping elements are fixed. Alternatively or additionally, the clamping member on the one side can also be fixed by a conventional tension anchor.

In one embodiment of the disclosure, the flexible tension anchor is not only a tension anchor for clamping the panel-shaped component between the groove flanks of the receiving groove, but alternatively or additionally also for bringing the clamping element disposed at the other side of the panel-shaped component into the corresponding clamping position. The tension anchor extends from the clamping element disposed on the other side of the panel-shaped component up to the one side, such that by pulling at the tension anchor on one side the clamping element on the other side can be moved or otherwise be manipulated. The movement of the clamping member disposed on the other side of the panel-shaped component into the corresponding clamping position is discussed later once more in the context of a "system for fastening a panel-shaped component in a receiving groove of a carrying rail".

Basically, the function of wedging is also provided when the two wedge-shaped clamping elements are inserted and fixed independently from each other. The tension anchor is thus used in its basic configuration mainly for bringing the clamping element facing away from the user in its position by means of a tensile force. By wedging (self-locking) each of both wedge-shaped clamping elements should also be retained alone.

According to a further embodiment of the disclosure, however, the fastening device also enables to fix the clamping position of the respective clamping element or even of both clamping elements by means of the tension anchor. A locking mechanism is required for this fixing operation. This locking mechanism may, for example—as known from the aforementioned document—be realized by a screw connection. According to a preferred embodiment of the disclosure, however, the flexible tension anchor comprises a ratchet mechanism including a pawl and/or a spindle drive. Unlike the screw connection here usually discretely stepped fixing positions are provided. A fixing of the wedge-shaped clamping elements against each other by means of a tension anchor provides additional security against loosening, but is not a mandatory requirement.

Here, the flexible tension anchor is preferably configured as a flexible tension anchor according to the ratchet strap principle, i.e. the principle according to which cable ties work. Here, the ratchet strap is generally formed as a flat strap comprising a plurality of ridges disposed distributed over the lengthwise direction of the strap and oriented itself transverse to this lengthwise direction. Then, for example, the pawl of the ratchet mechanism or the spindle or screw of the spindle drive acts on these ridges. However, unlike a cable tie, in one embodiment of the disclosure the ratchet strap is separate from the ratchet mechanism with the pawl. Such a flexible tension anchor according to the ratchet strap principle is usually flexible only in one direction or orientation. Especially in connection with said ratchet strap the ratchet mechanism with the pawl may also be replaced by a worm gear drive or a spindle drive known from hose clamps. By means of such a drive the positioning of the clamping element or the clamping elements can be carried out particularly precisely.

According to a further embodiment of the disclosure the holding element comprises at least two parts which can be clamped at the groove bottom to one another and to the panel-shaped component. The parts are configured and/or arranged within the holding element such that they can be clamped by actuating the flexible tension anchor or by a clamping step separate from the actuation of the flexible tension anchor.

According to a further embodiment of the disclosure, each or at least one of the clamping elements comprises at least two components which can be clamped (each) together between the panel-shaped component and the corresponding groove flank. It is advantageously provided that the components of the at least one clamping element comprise a latching structure for fixing their position relative to each other and that one of these components comprises a structure for a positive connection with a corresponding counter-structure at the groove flank. The latching structure may be based on the ratchet mechanism, for example. The structure of the one component is in particular a ridge structure and the counter-structure formed in the groove flank is a groove.

According to yet another embodiment of the disclosure, the flexible tension anchor comprises a predetermined breaking point, which is designed such that the flexible tension anchor separates at this point when a predefined tensile load is exceeded. Here, the predefined tensile load is dimensioned so that a sufficient clamping force is achieved.

The disclosure further relates to the use of an abovementioned device for fastening a panel-shaped component in a receiving groove of a carrying rail. In other words, the disclosure relates to a method of fastening a panel-shaped component in a receiving groove of a carrying rail by means of the aforementioned fastening device. Here, a step of

- inserting the holding element, the clamping elements and the tension anchor extending from the side facing the user up to the clamping element arranged on the side of the carrying rail facing away from the user into the receiving groove of the carrying rail is assumed to be given.

This results in the following steps of the disclosure:

- inserting the panel-shaped component into a receiving groove of a carrying rail until an end face of the component inserted into the receiving groove is supported via the holding element of the device at the groove bottom of the receiving groove,
- aligning the panel-shaped component by pivoting/tilting the component in the receiving groove, and
- positioning the clamping elements for clamping the aligned component between the groove flanks of the receiving groove, wherein the clamping element disposed on the side of the carrying rail facing away from the user is positioned by the tension anchor extending from the side of the carrying rail facing the user up to this clamping element (disposed on the side of the carrying rail facing away from the user).

The side facing the user side corresponds to the "one side of the panel-shaped component", and the side of the carrying rail facing away from the user corresponds to "the other side of the panel-shaped component" of the fastening device described above.

Then, optionally subsequently the following step can be carried out:

fixing the clamping elements in the clamping position by means of at least one tension anchor.

Finally, the disclosure also relates to a system for fastening a panel-shaped component in a receiving groove of a carrying rail by means of an aforementioned fastening device and a tool for biasing the clamping elements. The tool is preferably formed lever-like, in particular formed like a cap lifter. In this case, the tool is supported on the one hand at the clamping element on the one side of the component in order to pull up/lift a portion of the flexible tension anchor present on this side in order to bias it. Alternatively, the tool is supported (optionally in a suitable groove) at the profile body of the carrying rail. Here, independently from each other a compressive force is applied to the wedge-shaped clamping member facing the tool and a tensile force is applied to the tension anchor of the wedge-shaped clamping element facing away from the tool, so that both wedge-shaped clamping elements can be moved or braced independently of one another. Here, the tool can also optionally be configured so that all three options (compressive force applied to the one wedge-shaped clamping member, tensile force applied to the tension anchor of the other wedge-shaped clamping member, simultaneous bracing of both wedge-shaped clamping elements against each other) can be used by different hand movements and/or use of a groove.

Hereinafter, the disclosure is explained by way of example with reference to the accompanying drawings based on a preferred embodiment, wherein the features described below both individually and in combination can represent an aspect of the disclosure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

In the drawings.

Corresponding reference numerals indicate corresponding parts throughout the several views of the drawings.

DETAILED DESCRIPTION

Example embodiments will now be described more fully with reference to the accompanying drawings.

Figure 1:
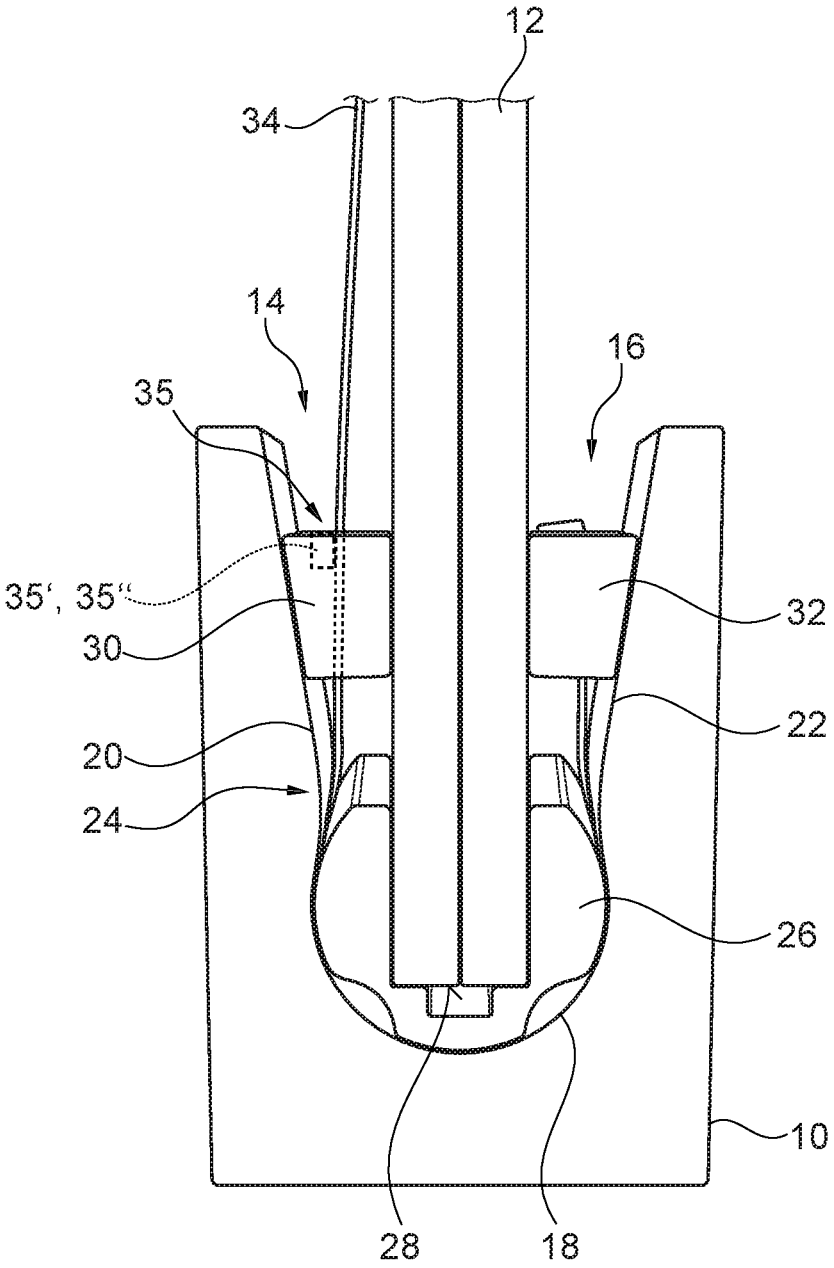
FIG. 1 is a front view of an assembly of a carrying rail, a panel-shaped component and a fastening device for fastening the component in the carrying rail according to a preferred embodiment of the disclosure.

FIG. 1 shows an assembly of a carrying rail 10, a panel-shaped component 12 and a fastening device 14 for fastening the panel-shaped component 12 in a receiving groove 16 of the carrying rail 10. The panel-shaped component 12 is a panel or a panel composite. In the example shown, a glass panel or a glass panel composite. The carrying rail 10 in the example shown is substantially U-shaped, thus having a base and two legs. The base of the carrying rail 12 is shaped so that the receiving groove 16 has a rounded groove bottom 18. The inner sides of the two legs form the groove flanks 20, 22 of the receiving groove 16. The groove flanks 20, 22—starting from the groove base 18—initially converge toward each other and then in turn diverge towards the free ends of the legs. Thus, a taper 24 of the receiving groove is obtained. At the lower area of the receiving groove 16 between the groove bottom 18 and the taper 24 a holding element 26 of the fastening device 14 is inserted. The holding member 26 ensures a retaining of the panel-shaped component 12 in the receiving groove 16 such that an end face 28 of the panel-shaped component 12 inserted into the receiving groove 16 is supported at the groove bottom 18 of the receiving groove 16 via the holding element 26. The holding element 26 is simultaneously a kind of damping element and a spacer, and in turn has a U-shape with a groove in which the panel-shaped component 12 is inserted in the area of its end face 28. Herein, the holding element 26 is shaped such or adapted to the shape of the receiving groove 16 such that the panel-shaped component 12 can be pivoted/tilted (to some degree) within the carrying rail 10.

On each of the both sides of the panel-shaped component 12 at least above the taper 24 a respective gap between the groove flank 20, 22 and component 12 is left. In each of these gaps a clamping element 30, 32 of the fastening device 14 is inserted. On the one side (shown here on the left) the one clamping element 30 is inserted in the gap, and on the other side (shown on the right) the other clamping element 32 is inserted in the other gap. Both clamping elements 30, 32 have a wedge shape for wedging the component 12 between the groove flanks 20, 22 of the receiving groove 16 which diverge in this area of the receiving groove 16, i.e. extend V-shaped. The clamping elements 30, 32 are thus shaped as positioning wedges. In each of the wedge-shaped clamping elements 30, 32 the flank respectively facing outwardly—i.e. facing the respective groove flank 20, 22—has a slight outward curvature.

The fastening device further comprises a flexible tension anchor 34 for positioning at least one of the clamping elements 32. Positioning at least one clamping element 30 32 in this context means: Moving this at least one clamping element 30, 32 into a clamping position and holding it in this clamping position, in which said panel-shaped component 12 is clamped or wedged and thus secured between the groove flanks 20, 22 of the receiving groove 16. Here, the flexible tension anchor 34 is flexible in at least one direction and extends for holding the clamping element 32 or the clamping elements 30, 32 in the clamping position from the one side of the panel-shaped component 12 around the end face 28 of the panel-shaped component 12 up to the clamping element 32 on the other side of the panel-shaped component 12 opposite the one side. There, at/in the clamping element 32 on the other side of the panel-shaped component 12 the tension anchor 34 is fixed tension-proof. In the example shown, the flexible tension anchor 34 comprises a flat strap.

In order to guide the flexible tension anchor 34 around the end face 28 of the panel-shaped component 12 it is deflected by means of the holding element 26 from the one side of the panel-shaped component 12 to the other side of the panel-shaped component 12. To this end, the tension anchor 34 is fed through a (not shown) channel in the holding element 26 which extends semi-circular from the one to the other side.

By means of the flexible tension anchor 34 the clamping element 30 on the one side of the panel-shaped component 12 shall become (be) connected tension-proof to the clamping element 32 on the other side of the panel-shaped component 12. To this end, the tension anchor 34 is also passed through a (also not shown) channel in the clamping element 30 on the one side and then fixed on the side of this clamping element 30 facing away from the holding element 26 (in this case the upper side) by means of a not shown locking mechanism of the tension anchor.

In the illustrated example, the flexible tension anchor 34 is formed as a tension anchor according to the ratchet strap principle. Here, the corresponding locking mechanism of the tension anchor 34 is a ratchet mechanism 35 comprising a pawl 35' and/or a spindle drive 35" .In this instance, the flexible tension anchor may be configured and identified as a ratchet strap 34 (previously described) to include a plurality of ridges (not shown) that cooperate with the pawl 35' or the spindle drive 35".

This results in the following function:

For fastening the panel-shaped component 12 in the receiving groove 16 of the carrying rail 10 by means of the device 14 the following steps are carried out:

(a) inserting the panel-shaped component 12 into the receiving groove 16 of the carrying rail 10 until an end face 28 of the inserted component 12 is supported at the groove bottom 18 of the receiving groove 16 via the holding element 26 of the device 14, (b) aligning the panel-shaped component 12 by pivoting/tilting the component in the receiving groove 16, (c) positioning the two clamping elements 30, 32 for clamping the aligned component 12 between the groove flanks 18, 20 of the receiving groove 16, wherein the clamping element 32 disposed on the side of the carrying rail 10 facing away from the user is positioned by means of the flexible tension anchor 34 extending from the side of the carrying element 10 facing the user up to this clamping element 32 (disposed on the side of the carrying element 10 facing away from the user), and (d) fixing the clamping elements 30, 32 in a clamping position corresponding to the desired orientation of the panel-shaped component 12 by means of the tension anchor 34.

Figure 2:
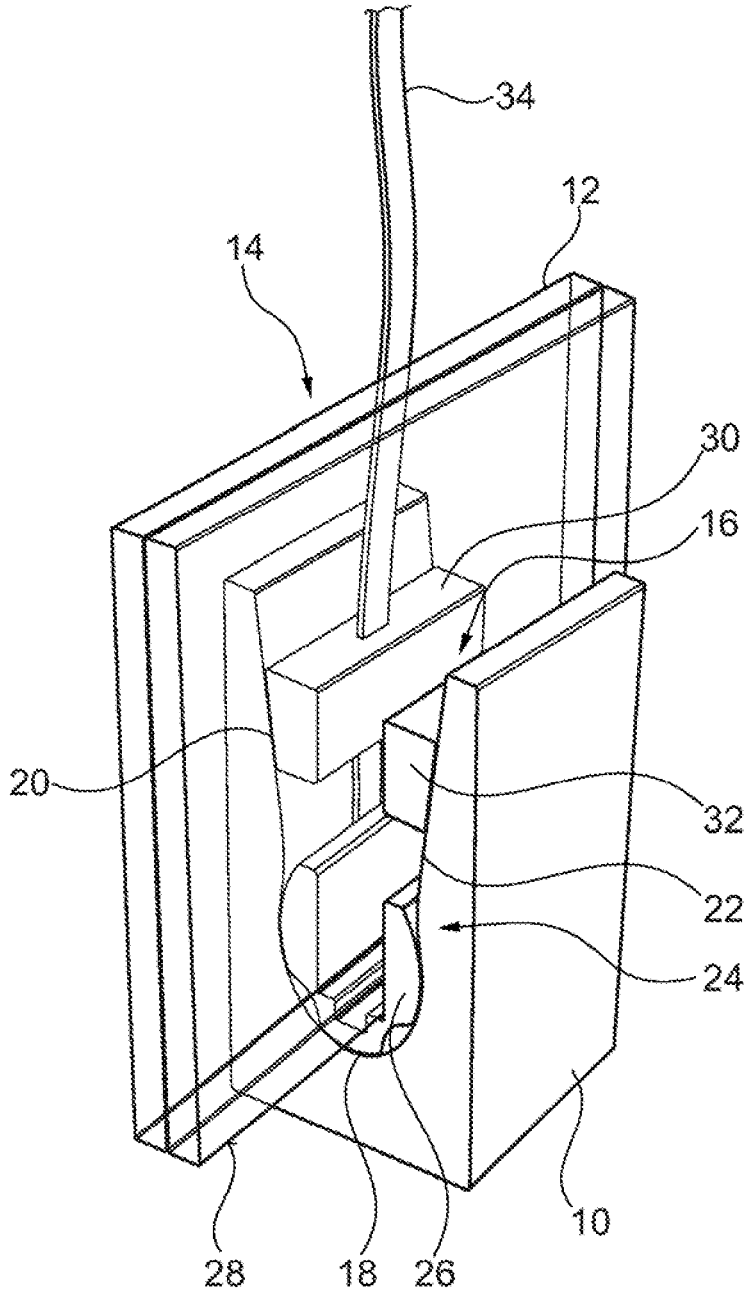
FIG. 2 is a diagram of the assembly of FIG. 1 from a different viewing angle.

FIG. 2 shows a diagram of the assembly of the carrying rail 10, the panel-shaped component 12 and the fastening device 14 from a different viewing angle. Here the U-shape of the holding element 26 is clearly visible. The panel plane of the panel-shaped component 12 or the longitudinal extension of the carrying rail is shown.

For an easy attachment of the panel-shaped component 12 in the receiving groove 16 of the carrying rail 10 furthermore a tool 50 (shown in FIG. 3) for biasing the clamping elements 30, 32 is provided. Here, the tool 50 is preferably formed lever-like, in particular in the form of a cap lifter, thus similar to a bottle opener. In this case, on the one hand the tool 50 is supported at the clamping element 30 on the one side of the component 12 in order to pull/lift a portion of the flexible tension anchor 34 present on this side in order to bias it. Since by means of the tension anchor 34 the clamping position of the clamping elements 30, 32 is to be fixed, a locking mechanism is required for this fixing process. This locking mechanism may be, for example, the aforementioned ratchet mechanism 35 comprising a pawl 35'. In this way, discretely stepped locking positions are obtained.

Accordingly, altogether the following advantage is achieved:

The measures mentioned allow for easy and secure fastening the panel-shaped component 12 in the receiving groove 16 of the carrying rail 10 which can be done from one side of the panel-shaped component 12 inserted into the receiving groove 16. This side is called "the one side" in the description of the embodiment shown. A fastening of the panel-shaped component 12 in the receiving groove 16 of the carrying rail 10 which can be done from one side of the panel-shaped component 12 inserted into the receiving groove 16 is in particular of advantage in the corresponding fastening of a glass panel of a glass balustrade.

Figure 3:
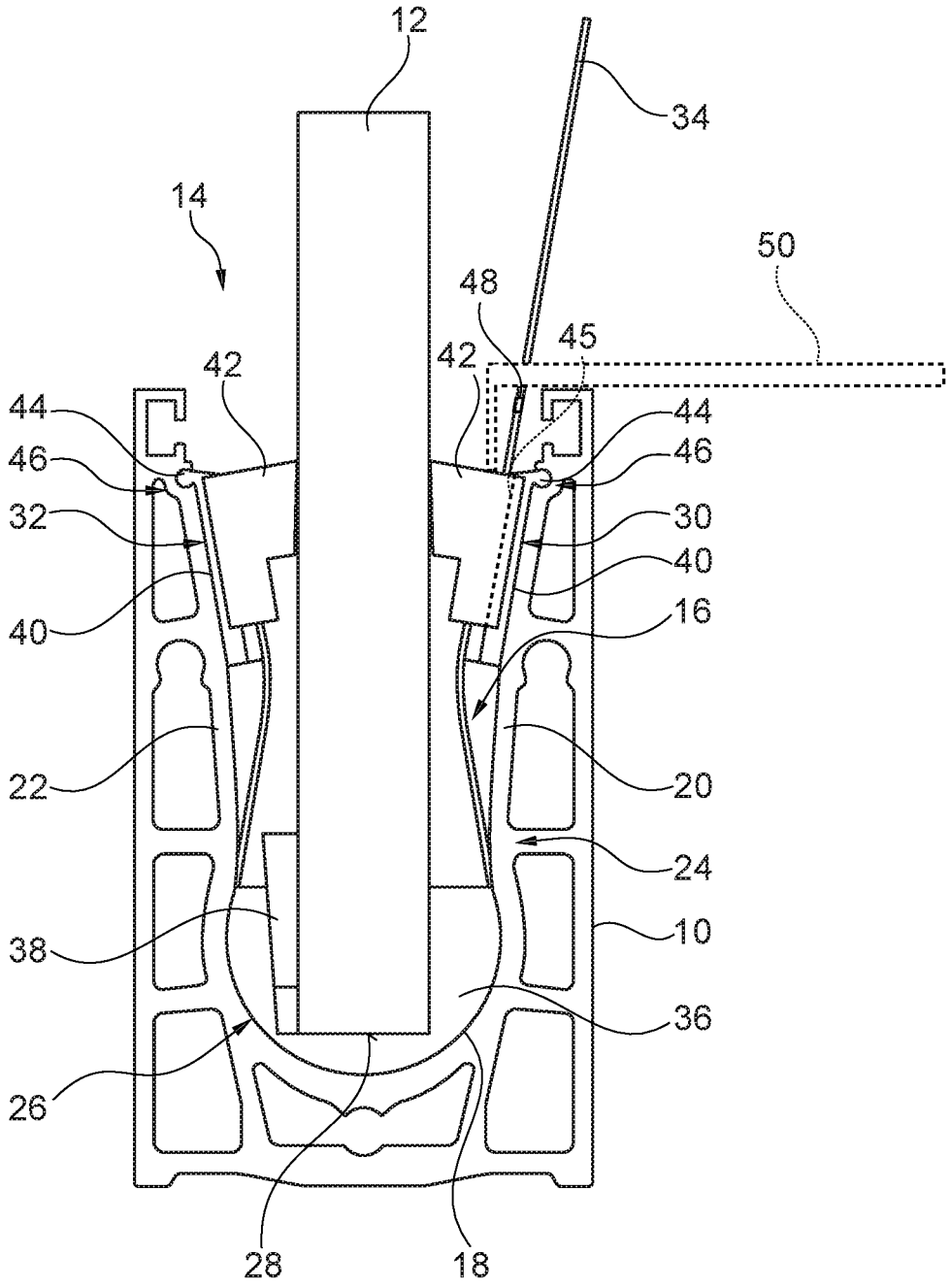
FIG. 3 is a front view of an assembly of a carrying rail, a panel-shaped component and a fastening device for fastening the component in the carrying rail according to a further embodiment of the disclosure.
Figure 4:
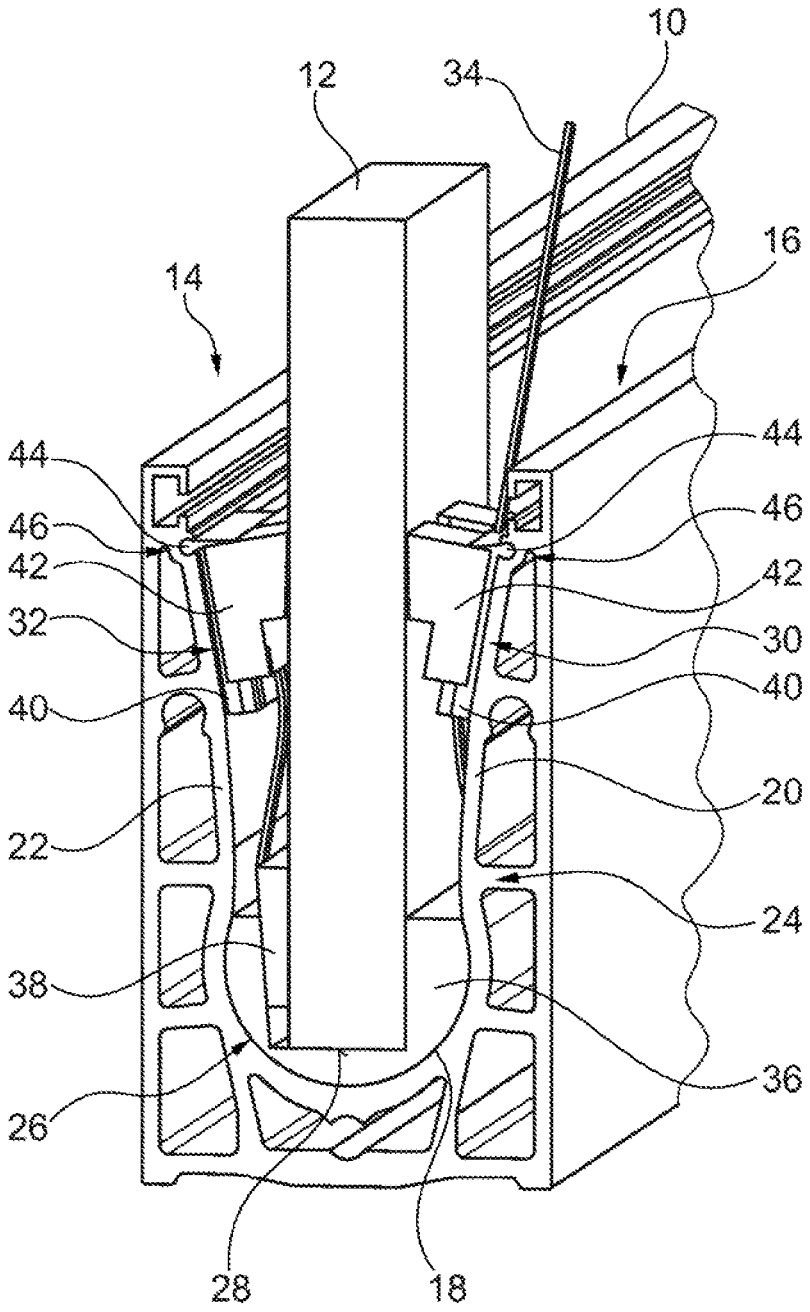
FIG. 4 is a diagram of the assembly of FIG. 3 from another viewing angle.

FIGS. 3 and 4 show an assembly of a carrying rail 10, a panel-shaped component 12 and an alternatively configured fastening device 14 for fastening the component 12 in the carrying rail 10. The general structure of the fastening device 14 shown in FIGS. 3 and 4 is basically identical to that of the fastening device 14 shown in FIGS. 1 and 2 so that only the differences will be discussed below.

The holding element 26 of the fastening device 14 shown in FIGS. 3 and 4 is formed in two parts. FIG. 3 shows the corresponding situation in a front view. One of these parts 36 forms the outer basic shape of the holding element 26 as already known from FIGS. 1 and 2, i.e. a U-shape with a groove into which the assembled panel-shaped component 12 is inserted in the area of its end face 28. The other of these parts 38 is wedge-shaped and can be inserted on the one side between the panel-shaped component 12 and the corresponding leg of the U-shape of the one part 36. Here, the one part 36 forms a guide for the other part 38. By inserting the wedge-shaped other part 38 the legs of the one part 36 spread and the two parts 36, 38 as well as the panel-shaped component 12 are finally clamped together on the groove bottom 18.

The following differences result compared with the steps described in connection with FIGS. 1 and 2 for fastening the panel-shaped component 12 in the receiving groove 16 of the carrying rail 10 by means of the device 14:

(a) inserting the panel-shaped component 12 into the receiving groove 16 of the carrying rail 10 until an end face 28 of the inserted component 12 is supported at the groove bottom 18 of the receiving groove 16 via the one part 36 of the holding element 26 of the device 14, (a1) inserting the other part 38 into a gap between the panel-shaped component 12 and the corresponding leg of the U-shape of the one part 36, (b) aligning the panel-shaped component 12 by pivoting/tilting the component 12 within the receiving groove 16, (b1) clamping the parts 36, 38 and the panel-shaped component 12 together at the groove bottom 18 of the receiving groove 16 by wedging.

A further difference from the embodiment of the device 14 shown in FIGS. 1 and 2 results from the clamping elements 30, 32. Each of the clamping elements 30, 32 shown in FIGS. 3 and 4 has two components 40, 42 clampable together between the panel-shaped component 12 and the corresponding groove flank 20, 22.

The respective one of these components 40 is provided for abutting at the corresponding groove flank 20, 22, the other of these components 42 is provided for abutting at the corresponding side of the panel-shaped component 12. The wedge shape of each of the clamping elements 30, 32 is essentially caused/determined by the respective other component 42. The respective one component 40 has a more plate-like basic shape with a structure 44 for a positive connection to a corresponding counter-structure 46 at the groove flank 20, 22, via which it can be attached or secured to this groove flank 20, 22. In the example shown, the structures 44 of the one component 40 are ridge structures and the counter-structures 46 formed in the groove flanks are grooves extending in the longitudinal direction of the carrying rail 10.

Similar to the parts of the holding element 26, a guide of the respective one component 40 for the clamping movement of the respective other component 42 is also obtained in the case of the clamping elements 30.

The components 40, 42 of each of the clamping elements 30, 32 form a latching structure 45 disposed between the two components 40, 42 for fixing the position of the components 40, 42 relative to each other. The latching structure is based for example on the ratchet mechanism. In this case, the first of the components 40, 42 comprises at least one pawl and the second of the components 42, 40 comprises the corresponding structures for an engagement of the pawl.

FIG. 4 shows a diagram of the assembly of FIG. 3 from a different viewing angle.

The following differences compared with the steps described in connection with FIGS. 1 and 2 for fastening the panel-shaped component 12 in the receiving groove 16 of the carrying rail 10 by means of the device 14 arise:

(b2) fastening the respective one component 40 of the clamping elements 30, 32 to the respective groove flank 20, 22 via the associated structure/counter-structure 44, 46, (c) positioning the two other components 42 of the clamping elements 30, 32 for clamping the aligned component 12 between the groove flanks 18, 20 of the receiving groove 16, wherein the other component 42 of the clamping element 32 disposed on the side of the carrying rail 10 facing away from the user is positioned by means of the flexible tension anchor 34 extending from the side of the carrying rail 10 facing the user up to this clamping element 32 (on the side of the carrying rail 10 facing away from the user), and (d) automatically fixing the two clamping elements 30, 32 in a clamping position corresponding to the desired orientation of the panel-shaped component 12 by means of the respective latching structure 45 (here in the example based on the ratchet mechanism).

The flexible tension anchor 34 is used in this embodiment of the fastening device 14 only for positioning the clamping elements 30, 32 or the components of these clamping elements 30, 32 while the fixing of the clamping elements 30, 32 is implemented in another way.

This has the consequence that the flexible tension anchor 34 in this embodiment of the fastening device 14 is no longer required at the end of the fastening process of the panel-shaped component 12 in the receiving groove 16 of the carrying rail 10 and can be removed.

According to a further embodiment, shown in FIG. 3, the flexible tension anchor to this end comprises a predetermined breaking point 48, which is configured such that the flexible tension anchor separates (for example, tears off) at this point when a predefined tensile load is exceeded. Here, the predefined tensile load is dimensioned such that a sufficient clamping force of the clamping elements 30, 32 is achieved beforehand. The tension anchor 34 attached tension-proof at an attachment point at/in the clamping element 32 on the other side of the panel-shaped component 12 comprises the predetermined breaking point 48 for example in the region of this attachment point. In this way no or only a barely visible remainder of the tension anchor 34 remains after the attachment of the panel-shaped component 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A device for fastening a panel-shaped component in a receiving groove of a carrying rail, comprising:

a holding element for holding the panel-shaped component in the receiving groove such that an end face of the panel-shaped component inserted into the receiving groove is supported at a groove bottom of the receiving groove via the holding element;

two clamping elements for clamping the panel-shaped component between the groove flanks of the receiving groove; and at least one tension anchor for positioning the clamping elements;

wherein the tension anchor or at least one of the tension anchors is configured flexible and extends from one side of the panel-shaped component around the end face of the panel-shaped component up to the clamping element to be positioned by this flexible tension anchor on another side of the panel-shaped component opposite the one side.

2. The device according to claim 1, wherein the clamping elements have a wedge shape for wedging the panel-shaped component between the groove flanks of the receiving groove.

3. The device according to claim 1, wherein the flexible tension anchor is deflected by means of the holding element from the one side of the panel-shaped component to the other side of the panel-shaped component.

4. The device according to claim 1, wherein the holding element is formed as a holding element which prevents a tilting of the panel-shaped component inserted in the receiving groove but not yet clamped.

5. The device according to claim 1, wherein the flexible tension anchor is adapted to connect the clamping element on the one side of the panel-shaped component to the clamping element on the other side of the panel-shaped component in a tension connection.

6. The device according to claim 1, wherein the flexible tension anchor is a tension anchor for bringing the clamping element disposed on the other side of the panel-shaped component into a corresponding clamping position.

7. The device according to claim 1, wherein the flexible tension anchor includes a ratchet mechanism comprising a pawl and/or a spindle drive.

8. The device according to claim 1, wherein the flexible tension anchor includes a ratchet strap.

9. The device according to claim 1, wherein the holding element comprises at least two parts clampable at the groove bottom with each other and with the panel-shaped component.

10. The device according to claim 1, wherein each or at least one of the clamping elements comprises at least two components clampable with each other between the panel-shaped component and the corresponding groove flank.

11. The device according to claim 10, wherein the components of the at least one clamping element have a latching structure for fixing their position relative to each other and that one of these components has a structure for a positive connection to a corresponding counter-structure at the groove flank.

12. The device according to claim 1, wherein the flexible tension anchor comprises a predetermined breaking point configured such that the flexible tension anchor is separated at this point when a predetermined tensile load is exceeded.

13. A method for fastening a panel-shaped component in a receiving groove of a carrying rail with a device according to claim 1, the method comprising biasing the clamping elements of the device with a tool.

* * * * *